US006619647B2

(12) United States Patent
Post et al.

(10) Patent No.: US 6,619,647 B2
(45) Date of Patent: Sep. 16, 2003

(54) DEVICE FOR LOADING A FEEDER RACK

(75) Inventors: Klaus P. Post, Bramsche (DE); Andreas Walther, Stadthagen (DE)

(73) Assignee: Kolbus GmbH & Co. KG, Rahden (DE)

( * ) Notice: Subject to any disclaimer, the term of this patent is extended or adjusted under 35 U.S.C. 154(b) by 0 days.

(21) Appl. No.: 10/190,869

(22) Filed: Jul. 8, 2002

(65) Prior Publication Data

US 2003/0015834 A1 Jan. 23, 2003

(30) Foreign Application Priority Data

Jul. 21, 2001 (DE) ..... 101 35 666

(51) Int. Cl.[7] ..... B65H 85/00

(52) U.S. Cl. ..... 271/3.01; 271/3.12; 271/256; 271/258.01; 271/265.04; 271/262; 271/263; 271/258.02; 271/270

(58) Field of Search ..... 271/301, 3.03, 271/3.05, 3.06, 3.08, 3.09, 3.12, 3.13, 150, 265.04, 258.01, 262, 263, 258.02, 256, 270

(56) References Cited

U.S. PATENT DOCUMENTS

| | | | | | |
|---|---|---|---|---|---|
| 3,881,718 | A | * | 5/1975 | Fernandez-Rana et al. | 271/10.09 |
| 3,904,191 | A | * | 9/1975 | Maier et al. | 271/150 |
| 3,945,633 | A | * | 3/1976 | Knopp | 271/3.12 |
| 4,008,890 | A | * | 2/1977 | Pulda | 271/151 |
| 4,049,260 | A | * | 9/1977 | Szymborski | 271/151 |
| 4,366,955 | A | * | 1/1983 | Pessina et al. | 271/7 |
| 4,588,180 | A | * | 5/1986 | Ballestrazzi et al. | 27/5 |
| 4,618,136 | A | * | 10/1986 | Pessina et al. | 271/150 |
| 4,869,486 | A | * | 9/1989 | Scarpa et al. | 271/3.12 |
| 4,973,038 | A | * | 11/1990 | Curley et al. | 271/146 |
| 5,249,788 | A | * | 10/1993 | Helmstadter | 271/10.07 |
| 5,387,078 | A | * | 2/1995 | Todaro | 414/798.9 |
| 5,394,979 | A | | 3/1995 | Hall et al. | |
| 5,508,818 | A | * | 4/1996 | Hamma | 358/403 |
| 5,996,988 | A | * | 12/1999 | Helmstadter et al. | 271/110 |
| 6,017,028 | A | * | 1/2000 | St. John et al. | 271/3.01 |
| 6,017,029 | A | * | 1/2000 | Bates et al. | 271/3.12 |
| 6,036,186 | A | * | 3/2000 | Glanzmann et al. | 271/150 |
| 6,220,590 | B1 | * | 4/2001 | Bates et al. | 271/3.01 |
| 6,385,406 | B1 | * | 5/2002 | Funamizu et al. | 399/16 |
| 6,508,465 | B1 | * | 1/2003 | Endo | 271/265.01 |
| 2002/0079635 | A1 | * | 6/2002 | Pessina et al. | 271/3.01 |

FOREIGN PATENT DOCUMENTS

| | | | | | |
|---|---|---|---|---|---|
| CH | 670441 | A | * | 6/1989 | B65H/3/02 |
| DE | 3403314 | A1 | | 8/1984 | |
| DE | 195 45 057 | C1 | | 8/1996 | |
| EP | 1 072 544 | A1 | | 7/1999 | |
| JP | 62269829 | A | * | 11/1987 | B65H/03/54 |
| JP | 05069984 | A | * | 3/1993 | B65H/7/02 |

* cited by examiner

*Primary Examiner*—Donald P. Walsh
*Assistant Examiner*—M Kohner
(74) *Attorney, Agent, or Firm*—Alix, Yale & Ristas, LLP

(57) ABSTRACT

In a device for loading further-processing machines with printed products, in particular a feeder rack (5) in gather-stitcher machines or gathering machines (6) for folded sheets (1), sheets, booklets or the like, which has a first conveyor arrangement (15) extending in planar manner for the purpose of feeding printed products (1) standing on their edges in the form of a horizontal stack (2), a second, initially upwardly sloping conveyor arrangement (16) for drawing the printed products (1) off the stack (2) in an overlapping formation and for transferring the overlapping stream (3) to the feeder rack (5), and infinitely variable drives (20, 24) associated with the two conveyor arrangements (15, 16), a control means (23) is provided which controls the two drives (20, 24) at a speed ratio to one another which is dependent on the thickness (D) of the printed products (1) to be processed. The overlapping formation is therefore effected in functionally reliable manner and it is substantially easier to set an optimum degree of overlap.

20 Claims, 1 Drawing Sheet

B
H
D
1
2
3
4
5
6
7
8
9
10
11
12
13
14
15
16
17
18
19
20
21
22
23
24
25
26
27
28
29
30
31
32
33
34
35
36
37
R
S

DEVICE FOR LOADING A FEEDER RACK

BACKGROUND OF THE INVENTION

The invention relates to a device for loading further-processing machines with printed products, in particular a feeder rack in gather-stitcher machines or gathering machines for folded sheets, sheets, booklets or the like.

Devices of this type are known as rod feeders, transfer devices, loading devices or delivery devices and are used to break up so-called rods of printed products and to transfer the printed products to a feeder rack of a further-processing machine, such as a gathering machine. For the purpose of breaking up the rod, the printed products are removed from the end face of the rod in overlapping manner, in that the horizontal rod is fed by a conveyor belt towards an upwardly sloping conveying transfer belt, where the conveying speed is greater than the feed speed of the first conveyor belt. As a result of the friction between the transfer belt and the end face of the rod, the printed products are drawn off the rod in an overlapping formation. The rod feeder can also be used to feed individual printed sheets onto the conveyor belt, thus significantly increasing the feeding capacity on the particular feeder rack.

The overlapping formation is determined by the friction ratios and is therefore dependent on the pressure ratios between the transfer belt and the end face of the rod or stack. The degree of overlap is increased as the pressure increases, i.e. the printed products are drawn off in close succession. However, if the pressure is too high, there is a risk of part stacks of printed products being drawn off or of the printed products being damaged. On the other hand, too low a pressure can result in breaks in the overlapping formation. A functionally reliable overlapping formation is desirable in that, for each printed product, the degree of overlap is approximately constant. An overlap of this type is in turn advantageous for the further transport of the overlapping stream and the transfer to the feeder rack. In order to achieve this for the overlapping formation, the feed of the rod or the stack has to correspond to the thickness of the drawn-off printed products.

In known rod feeders, the conveyer arrangements are driven by infinitely variable individual drives. The speeds are set by way of rotary potentiometers and this has to be effected by the operator setting the conveying speeds for the two conveyor arrangements as a result of observing the overlapping stream. This procedure is time-consuming, since a plurality of rod feeders can be used on a gathering machine, and it is imprecise.

SUMMARY OF THE INVENTION

The object of the invention is to provide a device for loading further-processing machines with printed products, in which the overlapping formation is effected in a functionally reliable manner and it is substantially easier to set an optimum degree of overlap.

This object is achieved according to the invention in surprisingly simple and economical manner by a control means, which sets the conveying speeds of the first conveyor arrangement (the conveyor belt for feeding the rod or stack) and the second conveyor arrangement (the transfer belt for drawing off and transferring the overlapping stream) in a ratio to one another which is dependent on the thickness of the printed products drawn off. The speed ratio is set automatically as a result of knowing this thickness. It is thus ensured that a constant degree of overlap is produced for each thickness of the printing products to be processed, in particular from the start of production. Manual adjustment of the device is reduced to a minimum.

A particularly economical device is produced if, according to a further development of the invention, the thickness of the printed products to be processed is input by way of an operating console and is thus made known to the control means. The operator determines the thickness by way of suitable measuring means. Particularly convenient operation is achieved if, according to an alternative further development, the control means has a measuring device. The control means determines the thickness automatically by way of a reference printed product. This is quick and precise. A further alternative further development provides for the thickness to be transmitted from the feeder rack to the control means by way of an electrical coupling. A thickness-checking arrangement is often found in a feeder rack of gathering machines and saddle stitching machines, it being possible to process the signals of said thickness-checking arrangement in the control means of the device. The device adjusts itself automatically to a new printed product and takes into account fluctuations in the thickness of the printed products.

The drive of the second conveyor arrangement is preferably constructed as the master which the drive of the first conveyor arrangement follows as the slave. The conveying speed of the second conveyor arrangement can thus be altered for the purpose of regulating the conveying capacity of the device, and the feed speed of the first conveyor arrangement adapts automatically to this altered conveying capacity. The conveying capacity can be regulated by hand or by appropriate control mechanisms which monitor the fill level of the rack, for example. The target values of the speed ratios for the particular thickness measurements are preferably stored in the control means. An advantageous further development provides for the speed ratio to be correctable by hand. The ratio provided by the control means for a particular thickness is thus adapted to product-specific properties (including surface of the printed products and compression of the rod or the stack).

BRIEF DESCRIPTION OF THE DRAWINGS

The invention is explained in more detail below with reference to the exemplary embodiment illustrated schematically in the drawing, wherein.

DESCRIPTION OF THE PREFERRED EMBODIMENT

Figures 1, 2:
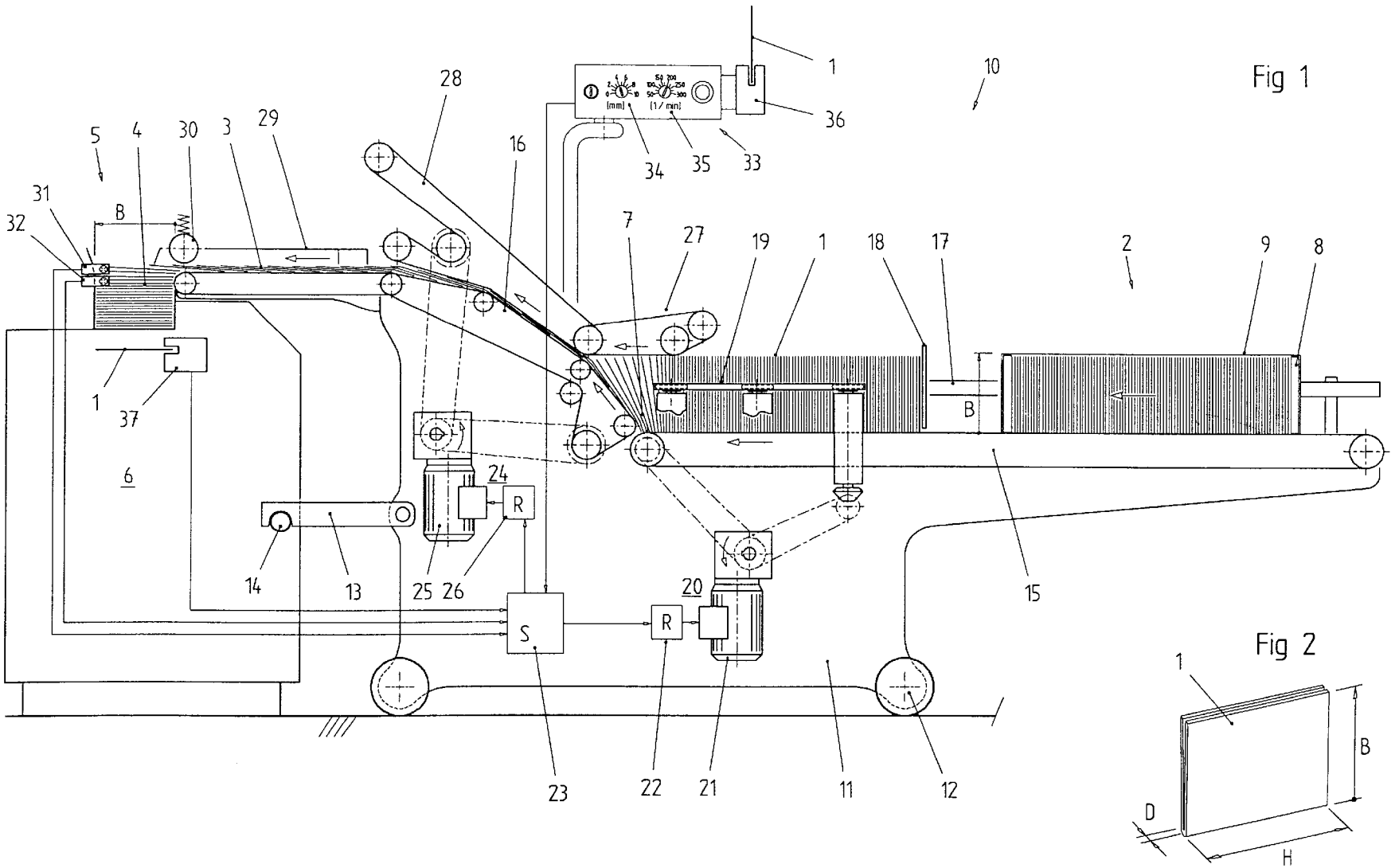
FIG. 1 shows a side view of a rod feeder as a device for loading a feeder rack in gathering machines for folded sheets.
FIG. 2 shows a perspective illustration of a folded sheet.

The rod feeder 10 is movably constructed on wheels 12 and is positioned on a feeder rack 5 of a gathering machine 6 by way of a notch lever 13 and a receiving means 14. It comprises a frame 11 in which a first conveyor arrangement (a substantially horizontal conveyor belt 15) and a second conveyor arrangement (an initially upwardly sloping and then substantially horizontally conveying transfer belt 16) are arranged. In the exemplary embodiment illustrated, the conveyor belt 15 serves to receive folded sheets 1 which are delivered to the conveyor belt standing on one of their edges in loose manner or bundled together to form a rod 2. The folded sheets 1, which are bundled together after folding to form the rod 2, are held at the ends by boards 8 which are braced together by hoop belts 9. The rods 2 can be moved by appropriate devices and are particularly suitable for relatively large batches of folded sheets 1. The rod 2 deposited on the conveyor belt 15 of the rod feeder 10 is firstly fed to the end of a previously deposited rod, where the folded sheets 1 are held in a standing stacked formation by a stack retainer 18. The stack retainer 18 can be pivoted out and placed behind the newly supplied rod 2. The hoop belts 9 and the boards 8 are finally removed.

For the purpose of removing the folded sheets 1 of the rod 2 in overlapping manner, they are fed by the conveyor belt 15 towards the upwardly sloping conveying transfer belt 16, where the conveying speed is greater than the feed speed of the conveyor belt 15. In the overlap formation region 7, the folded sheets 1 are drawn off the rod 2 as an overlapping stream 3 due to the friction between the transfer belt 16 and the end face of the rod 2. As seen in the transport direction, lateral guides 17 are associated with the conveyor belt 15 at the rear, and transversely lying chain conveyors 19 are associated with the conveyor belt 15 at the front. The latter are driven synchronously with the conveyor belt 15 and, approximately in the centre of their conveying path, constrict the transport channel for the folded sheets 1 such that these latter are forced to bulge out. The folded sheets 1 are therefore loosened and can be moved away from one another more easily in overlapping manner. In the front region of the conveyor belt 15, an upper belt 27 is arranged above the folded sheets 1 and conveys the folded sheets 1 forwards towards the sloping transfer belt 16.

In the first upwardly sloping conveying portion, a synchronously driven upper belt 28 is associated with the transfer belt 16 for the purpose of reliably transporting the overlapping stream 3. In the second, substantially horizontal, conveying portion of the transfer belt 16, lateral guide plates 29 guide the overlapping stream 3. As a result of an upper roller 30, which is arranged at the end of the transfer belt 16 and located on the transfer belt 16, spring mounted by way of a rocking arm (not illustrated in more detail), the folded sheets of the overlapping stream 3 are fed or expelled into the feeder rack 5 of the schematically indicated gathering machine 6. A flat stack 4 of folded sheets 1 is formed in the feeder rack 5. In FIG. 1, the folded-sheet width of the folded sheet 1 is denoted by B. The further dimensions of a folded sheet 1, such as the folded-sheet height H and the folded-sheet thickness D (i.e., product edge thickness) can be seen in FIG. 2.

The conveyor belt 15 and the two lateral chain conveyors 19 are drive connected to an infinitely variable drive 20 which is formed by a gear motor 21 and a regulator 22. A further infinitely variable drive 24 is provided for driving the transfer belt 16 with the associated upper belt 28. The upper belt 27 is also coupled to this drive 24, which comprises a gear motor 25 and a regulator 26. Both drives 20, 24 are controlled by a central control means 23, the drive 24 of the transfer belt 16 being constructed as the master, and the drive 20 of the conveyor belt 15 following the drive 24 as the slave.

According to the invention, the two conveyor arrangements 15, 16 are operated at a particular speed ratio to one another for the purpose of generating a uniform overlapping stream 3 having a constant degree of overlap. This speed ratio is dependent of the thickness D of the folded sheets 1 to be processed. In the exemplary embodiment, the operator sets the thickness D of the folded sheets 1 to be processed manually on an operating console 33 of the rod feeder 10 by way of a rotary potentiometer 34 provided with a scale. The control means 23 associates this predetermined thickness D of the folded sheet 1 with a particular speed ratio for the two conveyor arrangements 15, 16, in that the corresponding value for the speed ratio is taken from a value table stored in the control means.

In the exemplary embodiment, the thickness D is measured by hand, for example with the aid of a calliper gauge, and set by a corresponding setting on the rotary potentiometer 34. Alternatively, the thickness D of the folded sheet 1 could be determined using a measuring device 36 in the rod feeder 10. A folded sheet is placed in a measuring device of this type at the start of production. The value determined is supplied directly to the control means 23. Thickness-checking devices 37 which measure the thickness D of separated folded sheets 1 during routine production are conventional on gathering machines 6. The signal generated there could likewise be supplied to the control means 23, so that this continuously receives updated thickness values for the folded sheets 1 to be processed. As a result of this alternative manner of specifying the thickness, the control means 23 could also automatically take into account fluctuations in the thickness of the material. When the thickness D is measured manually, it is possible to alter the input thickness D on the potentiometer 34 during production if the operator notices a deviation from the ideal degree of overlap.

As a result of the constant speed ratios between the conveyor belt 15 and the transfer belt 16, the delivery capacity of the rod feeder 10 can be regulated by altering the conveying speed of the transfer belt 16. The appropriate conveying speed of the transfer belt 16 is set on a rotary potentiometer 35, with which a scale representing the delivery capacity is associated. The conveying speed of the conveyor belt 15 is readjusted according to the setting on the rotary potentiometer 34. The operator can set the delivery capacity above the processing capacity of the gathering machine 6, so that this latter is always sufficiently loaded with folded sheets 1. One, and preferably two, light barriers 31 and 32 are mounted in the rack 5 of the gathering machine 6 for monitoring the fill level of the rack 5 as it is loaded with folded sheets 1. At least one of the light barriers is associated with the control means 23 of the rod feeder 10. The upper light barrier 31 stops the rod feeder 10, whereas the lower light barrier 32 restarts the rod feeder 10.

What is claimed is:

1. A device for loading a stream of sheet-like printed products standing on an edge having a thickness, into a feeder rack of a machine for further processing of the printed products, comprising:

a first conveyor for transporting printed products standing on edge in a horizontal stack;

a second conveyor extending obliquely upward for drawing the printed products off the horizontal stack in an overlapping stream and transferring the overlapping stream to said feeder rack;

a continuously variable drive associated respectively with each conveyor and;

control means for the drives for setting a speed ratio between the two conveyors in dependence on the thickness of the printed products to be processed.

2. A device according to claim 1, comprising a manually operated console operatively connected to the control means for generating an input to the control means commensurate with the thickness of the printed products.

3. A device according to claim 1, comprising a measuring device operatively connected to the control means for measuring the thickness of the printed products.

4. A device according to claim 1, comprising an electrical coupling between the control means and a thickness measuring device at the feeder rack, for automatically transmitting the thickness of the printed product.

5. A device according to claim 1, wherein the drive associated with the second conveyor is configured as a master which a drive associated with the first conveyor follows as a slave for the purpose of maintaining the speed ratio.

6. A device according to claim 1, wherein distinct target values of the speed ratio corresponding to particular thickness measurements are stored in the control means.

7. A device according to claim 1, comprising a manually operated console operatively connected to the control means for altering the speed ratio determined from the thickness of the printed products to be processed.

8. A device according to claim 3, wherein the drive associated with the second conveyor is configured as a master which a drive associated with the first conveyor follows as a slave for the purpose of maintaining the speed ratio, and wherein distinct target values of the speed ratio corresponding to particular thickness measurements are stored in the control means.

9. A device according to claim 5, comprising a manually operated console operatively connected to the control means for generating an input to the control means commensurate with the thickness of the printed products.

10. A device according to claim 5, comprising a measuring device operatively connected to the control means for measuring the thickness of the printed products.

11. A device according to claim 5, comprising an electrical coupling between the control means and a thickness measuring device at the feeder rack, for automatically transmitting the thickness of the printed product.

12. A device according to claim 6, comprising a manually operated console operatively connected to the control means for generating an input to the control means commensurate with the thickness of the printed products.

13. A device according to claim 6, comprising a measuring device operatively connected to the control means for measuring the thickness of the printed products.

14. A device according to claim 6, comprising an electrical coupling between the control means and a thickness measuring device at the feeder rack, for automatically transmitting the thickness of the printed product.

15. A device according to claim 6, wherein the drive associated with the second conveyor is configured as a master which a drive associated with the first conveyor follows as a slave for the purpose of maintaining the speed ratio.

16. A device according to claim 7, comprising a manually operated console operatively connected to the control means for generating an input to the control means commensurate with the thickness of the printed products.

17. A device according to claim 7, comprising a measuring device operatively connected to the control means for measuring the thickness of the printed products.

18. A device according to claim 7, comprising an electrical coupling between the control means and a thickness measuring device at the feeder rack, for automatically transmitting the thickness of the printed product.

19. A device according to claim 7, wherein the drive associated with the second conveyor is configured as a master which a drive associated with the first conveyor follows as a slave for the purpose of maintaining the speed ratio.

20. A device according to claim 7, wherein distinct target values of the speed ratio corresponding to particular thickness measurements are stored in the control means.

* * * * *